US006082104A

United States Patent [19]

Hyakutake et al.

[11] Patent Number: 6,082,104

[45] Date of Patent: Jul. 4, 2000

[54] STAINLESS DOUBLE TUBE EXHAUST MANIFOLD

[75] Inventors: Tetsuya Hyakutake, Nukata-gun; Hisanaga Matsuoka, Okazaki; Yoriaki Ando, Nagoya; Koichi Shimizu, Toyota; Kenichi Yamamoto, Okazaki, all of Japan

[73] Assignees: Nippon Soken, Inc., Nishio; Toyota Jidosha Kabushiki Kaisha, Toyota, both of Japan

[21] Appl. No.: 09/131,400

[22] Filed: Aug. 7, 1998

[30] Foreign Application Priority Data

Aug. 8, 1997 [JP] Japan ..... 9-215219
Apr. 2, 1998 [JP] Japan ..... 10-090057

[51] Int. Cl.[7] ..... F01N 7/10

[52] U.S. Cl. ..... 60/323; 29/890.08; 60/322

[58] Field of Search ..... 60/323, 324, 322, 60/312, 314, 299; 123/184.53, 184.57; 181/207, 210; 29/890.08, 407.01

[56] References Cited

U.S. PATENT DOCUMENTS 4,689,952 9/1987 Arthur et al. ..... 60/313
5,220,789 6/1993 Riley et al. ..... 60/302
5,253,680 10/1993 Matsumoto .
5,351,483 10/1994 Riley et al. ..... 60/274
5,419,127 5/1995 Moore, III ..... 60/322
5,682,741 11/1997 Auguatin et al. ..... 60/323
5,706,655 1/1998 Kojima et al. ..... 60/322

FOREIGN PATENT DOCUMENTS 57-79214 5/1982 Japan .
2-168097 6/1990 Japan .
6-31852 2/1994 Japan .
6-106672 4/1994 Japan .
8-170530 7/1996 Japan .

*Primary Examiner*—Thomas Denion
*Assistant Examiner*—Sneh Varma
*Attorney, Agent, or Firm*—Nixon & Vanderhye P.C.

[57] ABSTRACT

An exhaust manifold has inner and outer tubes made of stainless steel and welded to flanges provided at inlet ports of the exhaust manifold, from which exhaust gas discharged from an engine enters the exhaust manifold. The inner tube has flat portions, and shield plates disposed within the inner tube protect the flat portions from being directly vibrated by pressure waves of the exhaust gas. Accordingly, the vibration of the flat portions is lowered, so that high frequency noise from the exhaust manifold is reduced.

4 Claims, 18 Drawing Sheets

STAINLESS DOUBLE TUBE EXHAUST MANIFOLD

CROSS REFERENCE TO RELATED APPLICATIONS

This application is based upon and claims the benefit of priority of the prior Japanese Patent Applications No. 9-215219, filed on Aug. 8, 1997, and No. 10-90057, filed on Apr. 2, 1998, the contents of which are incorporated herein by reference.

BACKGROUND OF THE INVENTION

1. Field of the Invention

This invention relates to an exhaust manifold.

2. Description of the Related Art

Recently, an exhaust manifold as an engine exhaust pipe has been made of stainless (SUS), in stead of conventional cast iron, to comply with requirements for exhaust gas regulations, high heat resisting properties, and reduction of weight. Further, a double tube structure having a thin thickness inner tube has been becoming a mainstream for the stainless exhaust manifold to improve warming-up property of catalysts.

An example of this kind of stainless double tube exhaust manifold is shown in FIGS. 33–35. An exhaust manifold 80 shown in FIGS. 33–35, which is mounted on a left bank (#1, #3, #5 cylinders) of a V-type six-cylinder engine, is formed from two plate members each deformed into an exhaust manifold shape and welded at joining faces. The exhaust manifold 81 has head flanges 81 that are bolted to specific portions of exhaust ports of cylinders on an engine side, and a flange 82 that is bolted to a crossover pipe. An inner tube 83 having a thickness of 0.8 mm is welded to the head flanges 81, while an outer tube 84 having a thickness in a range of 20. mm to 3.0 mm is welded to the flange 82 as well as to the head flanges 81. As shown in FIG. 35, the inner and outer tubes 83, 84 respectively have butting portions 85, 85*a* facing to one another on a side opposite to the head flange side, and each of the inner and outer tubes 83, 84 is welded at the respective butting portion 85 or 85*a*. High pressure exhaust gas discharged from the exhaust port of each cylinder passes through the exhaust manifold 80 and is discharged into atmosphere through the crossover pipe, a front pipe, and a muffler.

However, the exhaust manifold 80 having the structure described above generates high frequency noise (radiation noise) having more than 1 kHz in frequency. This problem is peculiar to the exhaust manifold made of stainless. That is, as shown in FIG. 35, pressure waves of exhaust gas compressed in the engine enter the inner tube 83 immediately after an exhaust valve is opened. At that time, the pressure waves progress toward the butting portion 85 in direction P1 while vibrating flat portions 86 of the inner tube, is reflected at the butting portion 85, and then returns in direction P2 while vibrating the flat portions 86 again. The vibration generated at the flat portions 86 is transmitted to the entire area of the inner tube 83. The vibration is further transmitted to the outer tube 84 from the inner tube 83 through the head flanges 81, and then causes the high frequency (1 kHz–20 kHz) noise.

SUMMARY OF THE INVENTION

The present invention has been made in view of the above problem. An object of the present invention is to prevent high frequency noise caused by vibration of an inner tube of a stainless double tube exhaust manifold.

Briefly, according to the present invention, an exhaust manifold has a stainless inner tube having a plurality of intake ports for receiving exhaust gas from an engine and an exhaust port for discharging the exhaust gas, and a stainless outer tube disposed on an outside of the inner tube to define a space with the inner tube. Further, a cover plate is disposed in the inner tube to face a specific portion of the inner tube that receives pressure waves of the exhaust gas from one of the plurality of inlet ports. Accordingly, vibration of the specific portion caused by the pressure waves can be lowered by the cover plate, so that high frequency noise from the exhaust manifold is lowered.

The cover plate may be fixed to a flange disposed at a periphery of one of the inlet ports and be elongate to face the specific portion. Preferably, in this case, the cover plate has a circular arc like shape. Otherwise, the cover plate may be directly fixed to the specific portion of the inner tube. The specific portion is generally flat.

The inner tube can have a plurality of through holes at the specific portion of the inner tube in stead of employing the cover plate. Accordingly, the pressure waves having a specific frequency can be lowered, and therefore the high frequency noise from the exhaust manifold is reduced. Further, the area of the specific portion for receiving the pressure waves is reduced, resulting in reduction of the high frequency noise. Further, preferably, an energy absorbing member is disposed in the space between the inner and outer tubes.

The exhaust manifold may have a member contacting the inner and outer tubes in the space between the inner and outer tubes so as to reduce the vibration by means of contact friction between the member and the inner and outer tubes. Preferably, the member is a corrugated sheet. More preferably, the corrugated sheet is composed of two sheet members face-contacting one another. The member may be employed together with the cover plate and/or the plurality of through holes. Further, the outer tube may be composed of outer and inner plate members face-contacting one another. Accordingly, the high frequency noise is further reduced. In this case, the outer and inner plate members can be spot-welded at a portion corresponding to antinode of the vibration. Preferably, a thickness of the outer plate member is thicker than that of the inner plate member. Incidentally, it is apparent that the reduction of the high frequency noise can be realized to some extent only by the outer tube composed of the outer an inner plate members.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS

First Embodiment

A stainless double tube exhaust manifold 1 in a first preferred embodiment is for being mounted on a left bank of a V-type six-cylinder engine. The left bank of the engine holds another stainless double tube exhaust manifold having the similar structure to that of the manifold 1.

Figure 1:
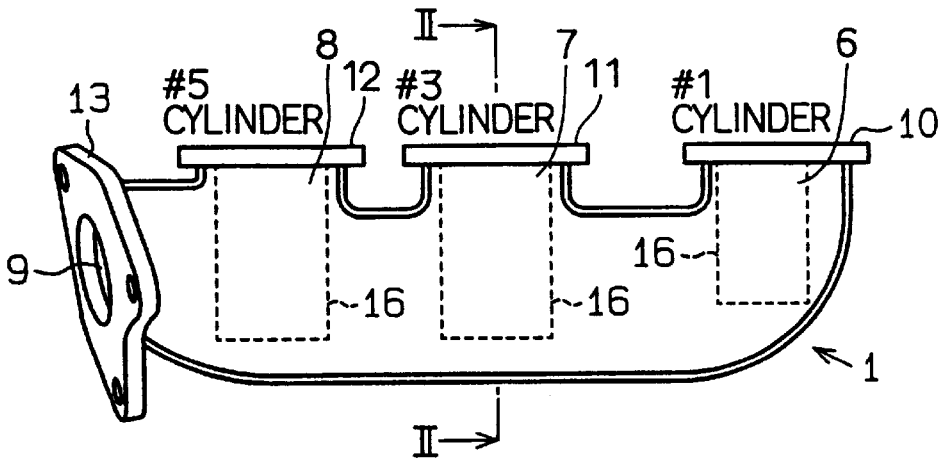
FIG. 1 is a schematic view showing a stainless double tube exhaust manifold in a first preferred embodiment.
Figure 2:
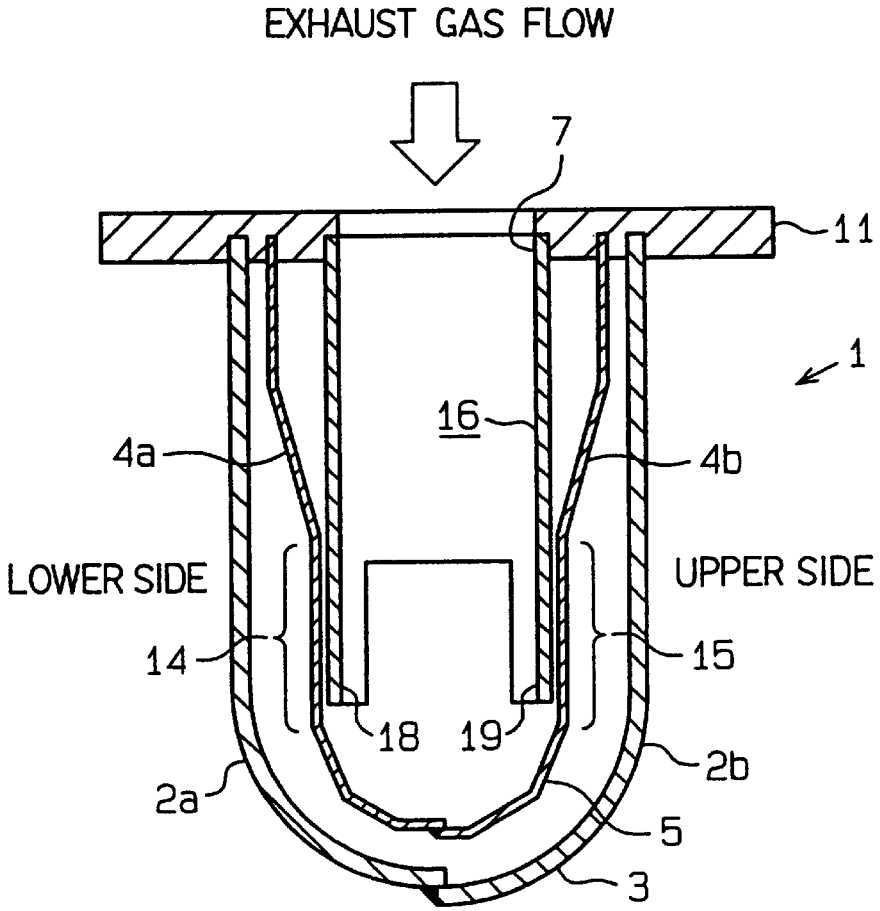
FIG. 2 is a cross-sectional view taken along a II—II line in FIG. 1.

Referring to FIGS. 1, 2, the exhaust manifold 1 has an outer tube 3 formed from two stainless steel plates 2*a*, 2*b* which are formed into a specific shape and are welded to one another at joint faces. In FIG. 2, the stainless steel plate 2*a* is disposed on a lower side, while the stainless steel plate 2*b* is disposed on an upper side. The thickness of the outer tube 3 is approximately 2.0 mm–3.0 mm. Accordingly, the outer tube 3 can provide a sufficient mechanical strength. Likewise, an inner tube 5 is formed from two stainless steel plates 4*a*, 4*b* which are formed into a specific shape and are welded to one another at joint faces. In FIG. 2, the stainless steel plate 4*a* is disposed on the lower side and the stainless steel plate 4*b* is disposed on the upper side. The thickness of the inner tube 5 is approximately 0.8 mm. Accordingly, calorific capacity of the inner tube 5 becomes small, so that a temperature of catalysts disposed on the downstream side for purifying exhaust gas can be rapidly raised.

The double tube composed of the outer tube 3 and the inner tube 4 has three intake ports 6, 7, 8 for the first (#1), third (#3), and fifth (#5) cylinders of the engine, and has an exhaust port 9. Head flanges 10, 11, 12 are respectively welded to the outer and inner tubes 3, 5 at the intake ports 6, 7, 8. At the exhaust port 9, a flange 13 is welded to the outer tube 3. When the six-cylinder engine is driven, exhaust gas is discharged in a compressed state from exhaust ports of the #1, #3, #5 cylinders to flow into the exhaust manifold 1 form the inlet ports 6, 7, 8, and then is discharged together from the exhaust manifold 1 through the exhaust port 9.

In the exhaust manifold 1 in this embodiment, referring again to FIG. 2, the inner tube 5 is formed to have flat portions 14, 15 where the exhaust gas is introduced from each of the cylinders. Further, flat portion cover tubes 16 having high rigidity are disposed within the inner tube 5 to cover the flat portions 14, 15. Specifically, the flat portion cover tubes 16 are respectively fixed to peripheries of the intake ports 6, 7, 8 to cover all of the flat portions 14, 15.

Figure 3A:
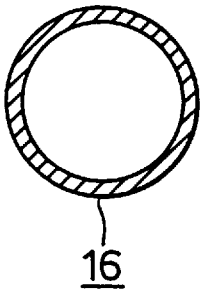
FIG. 3A is a top plan view showing a flat portion cover tube of the exhaust manifold in the first embodiment.
Figure 3B:
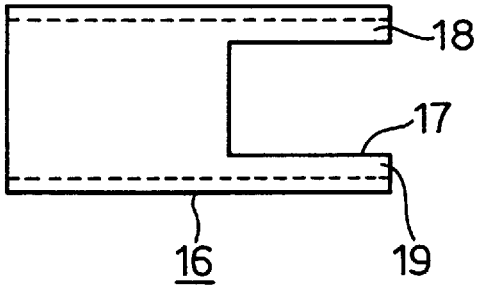
FIG. 3B is a side view showing the flat portion cover tube.
Figure 3C:
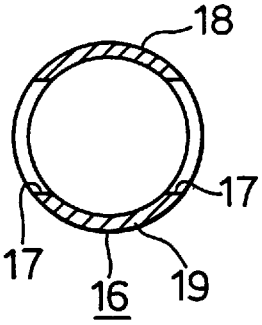
FIG. 3C is a bottom plan view showing the flat portion cover tube.

FIGS. 3A to 3C show the structure of each of the flat portion cover tubes 16. The flat portion cover tube 16 has a cylindrical shape and has a thickness of 1.0 mm–2.0 mm that is thicker than that (0.8 mm) of the inner tube 5 so that it has large rigidity. The base portion of the flat portion cover tube 16 is welded to each of the head flanges 10, 11, 12, and the front end portion of the flat portion cover tube 16 has two notch portions 17. The exhaust gas passes through the notch portions 17. That is, the flat portion cover tube 16 has the notch portions 17 not to disturb the exhaust gas flow. For example, the flat portion cover tube 16 shown in FIG. 2 is disposed for the #3 cylinder, and has the structure which is not liable to disturb the exhaust gas flow from the #1 cylinder. The front end portion of the flat portion cover tube 16 other than the notch portions 17 serves as circular-arc like shielding plates 18, 19. The shielding plates 18, 19 are disposed to face the flat portions 14, 15 with a slight gap therebetween so as to prevent the flat portions 14, 15 from being vibrated by the pressure waves of the exhaust gas.

Next, operation of the stainless double tube exhaust manifold 1 will be explained. As described above, the exhaust gas discharged from the cylinders of the six-cylinder engine enters the exhaust manifold 1 from the intake ports 6, 7, 8, and is discharged together from the exhaust manifold 1. The discharged exhaust gas meet with exhaust gas discharged from another exhaust manifold for a right bank of the engine in the crossover pipe, and then flows in the front pipe and in the muffler.

Figure 4:
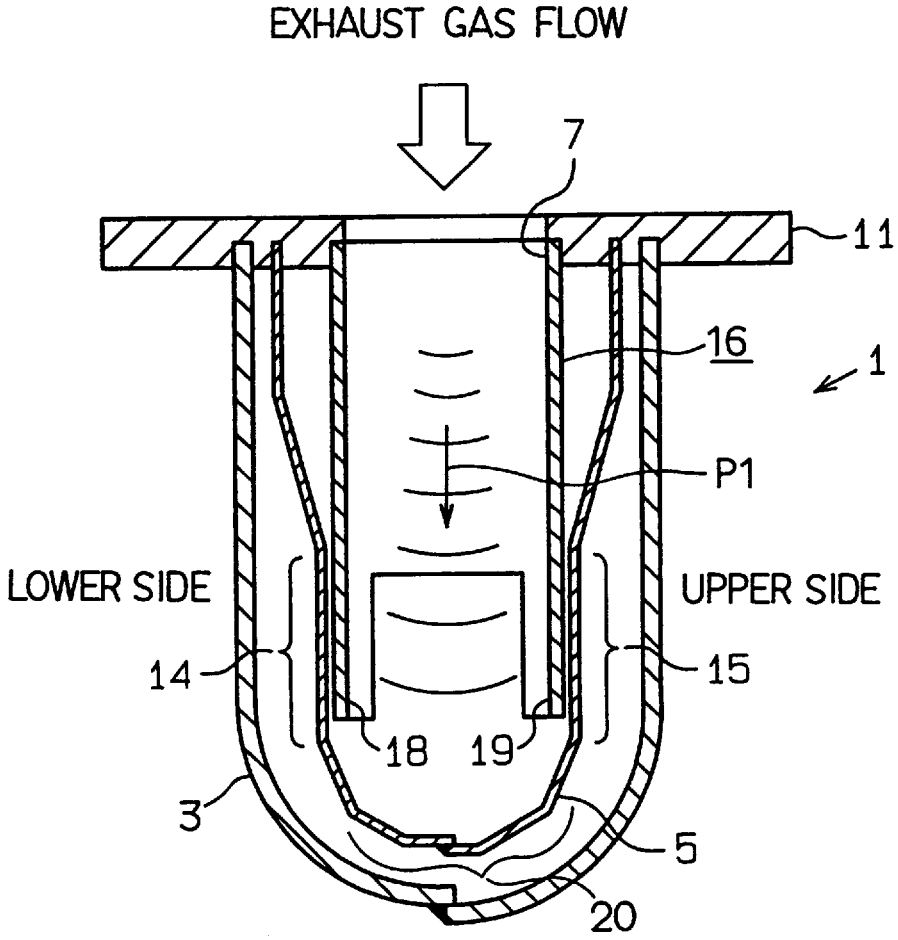
FIGS. 4, 5 are cross-sectional views for explaining operation of the exhaust manifold in the first embodiment.
Figure 5:
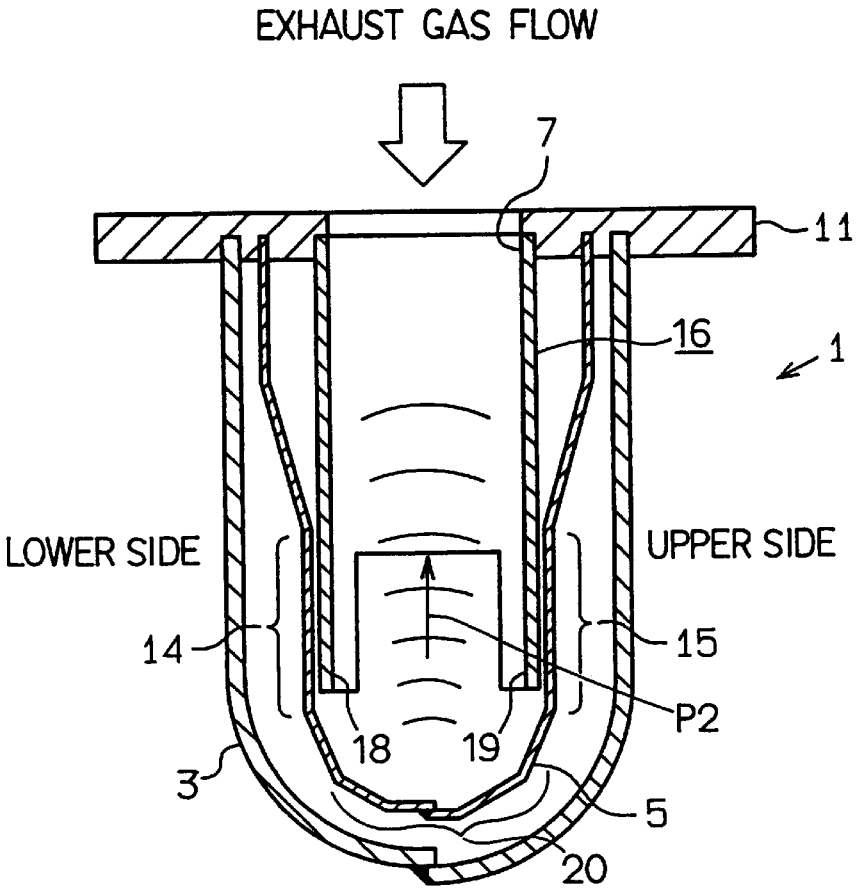

When the exhaust gas passes through the exhaust manifold 1, as shown in FIG. 4, the exhaust gas flows with radial pressure waves transmitted in direction P1. When the radial pressure waves pass through the flat portions 14, 15 of the inner tube 5, at that time, the shield plates 18, 19 of the flat portion cover tube 16 prevent the flat portions 14, 15 from being vibrated by the radial pressure waves. Referring to FIG. 5, the pressure waves transmitted from the intake port 7 hit against a butting portion 20 of the inner tube 5 to be reflected by the butting portion 20, and return toward the intake port 7 in direction P2. When the reflected pressure waves passes through the flat portions 14, 15, likewise, the shield plates 18, 19 prevent the flat portions 14, 15 from being vibrated by the pressure waves. Incidentally, the shield plates 18, 19 are relatively thick and have a circular arc like shape, respectively, so that the shield plates 18, 19 have high rigidity and are not liable to vibrates. As a result, high frequency noise from the exhaust manifold 1 can be significantly reduced.

Second Embodiment

Next, a second preferred embodiment will be explained focusing on points different from the first embodiment.

Figure 6:
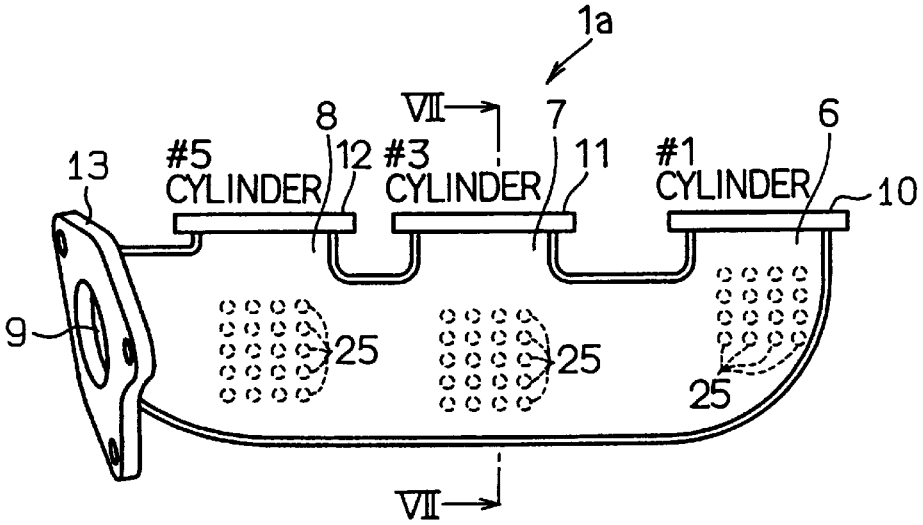
FIG. 6 is a schematic view showing an exhaust manifold in a second preferred embodiment.
Figure 7:
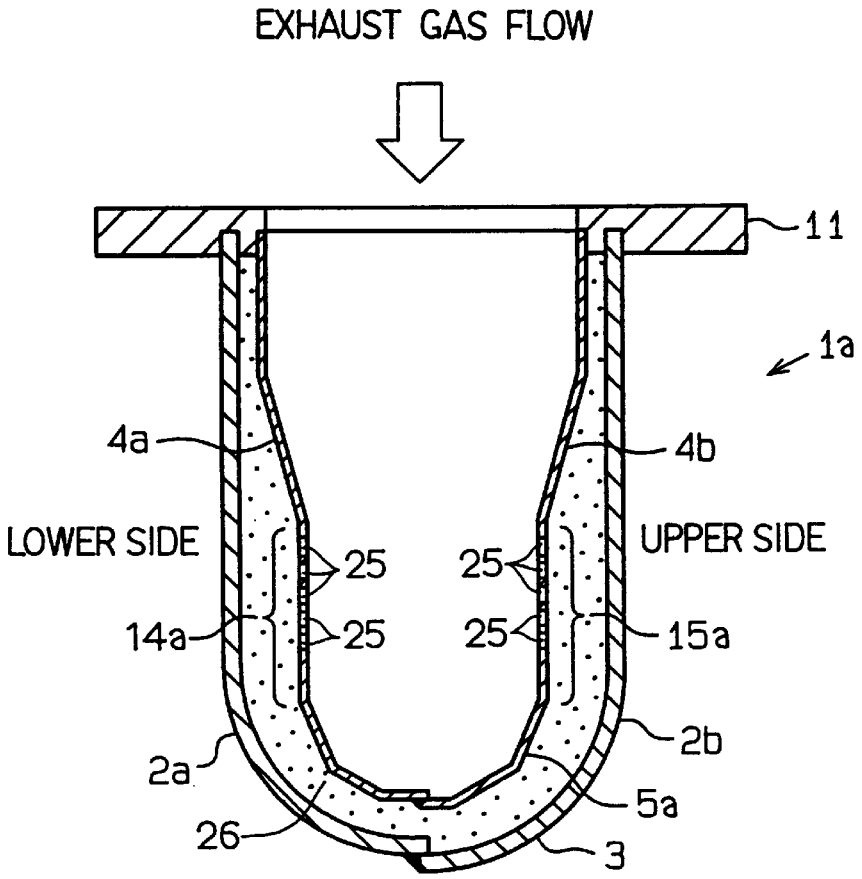
FIG. 7 is a cross-sectional view taken along a VII—VII line in FIG. 6.

FIGS. 6, 7 show an exhaust manifold 1*a* in the second embodiment, in which the same parts as those in the first embodiment are indicated with the same reference numerals. The appearance of the exhaust manifold 1*a* is substantially the same as that of the exhaust manifold 1 in the first embodiment. In this embodiment, a plurality of punch holes 25 are formed in flat portions 14*a*, 15*a* of an inner tube 5*a*, and a space defined between the outer and inner tubes 3, 5*a* is filled with a heat insulating material 26 such as heat resistance ceramic wool. A sound absorbing material can be used in stead of the heat insulating material 26.

Accordingly, as described above referring to FIG. 4, when the pressure waves of the exhaust gas discharged from the cylinders pass through the flat portions 14*a*, 15*a* of the inner tube 5*a*, the punch holes 25 and the heat insulating material 26 cooperatively serve as a resonance type silencer so that a pressure wave component having a specific frequency is damped. That is, because the flat portions 14*a*, 15*a* has the punch holes 25, when the pressure waves pass through the flat portions 14*a*, 15*a* first, the pressure wave component having the specific frequency can be damped so that the pressure waves capable of vibrating the flat portions 14*a*, 15*a* is damped. In addition, the areas of the flat portions 14*a*, 15*a* for receiving the pressure waves are decreased due to the punch holes 25, so that it becomes difficult for the flat portions 14*a*, 15*a* to vibrate. Accordingly, when the pressure waves are reflected by the butting portion 20 and passes through the flat portions 14*a*, 15*a* again, the pressure level is lowered.

As a result, the high frequency noise generated from the outer tube 3 can be reduced. The heat insulating material 26 filling the space between the outer tube 3 and the flat portions 14*a*, 15*a* of the inner tube 5*a* absorbs pressure energy of the exhaust gas. Accordingly, the high frequency noise from the outer tube 3 can be further reduced.

More specifically, because the pressure waves is damped when they pass through the flat portions 14*a*, 15*a* first, all three vibration factors of the flat portions 14*a*, 15*a* (vibration caused by the pressure waves passing through first, vibration caused by the reflected pressure waves passing through again, and transmittance of vibration generated at the abutting portion 20) are lowered.

Figure 8:
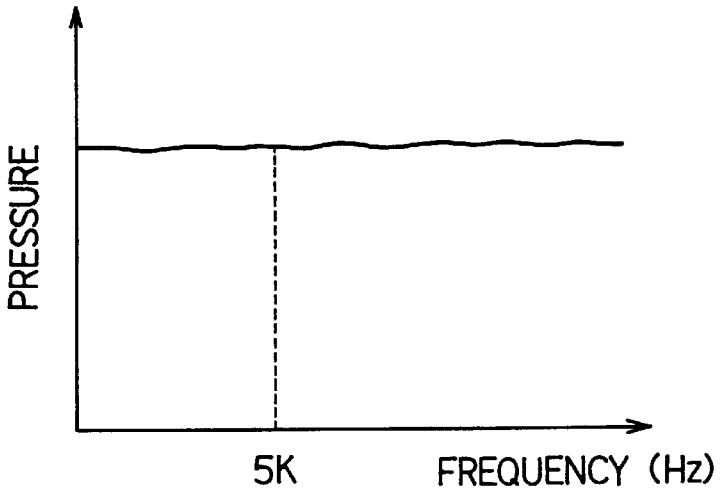
FIGS. 8 to 10 are graphs showing frequency properties.
Figure 9:
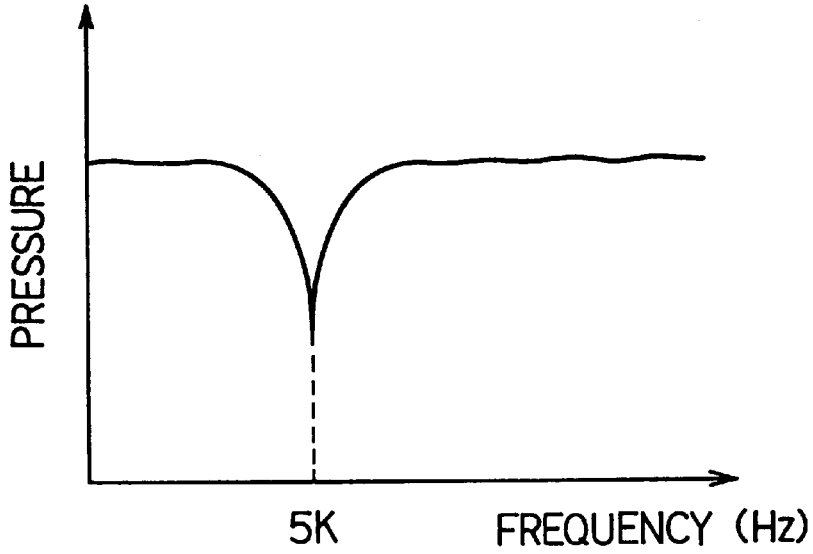

The vibration reduction effect by the punch holes 25 will be explained with reference to FIGS. 8, 9. FIG. 8 shows a frequency property within the inner tube that does not have any punch holes 25, and FIG. 9 shows a frequency property within the inner tube that has the punch holes 25. When the inner tube does not have any punch holes 25, the pressure energy is high in a wide range of the frequency. As opposed to this, when the inner tube 5*a* has the punch holes 25, the pressure energy is significantly reduced at around 5 kHz in frequency.

Figure 10:
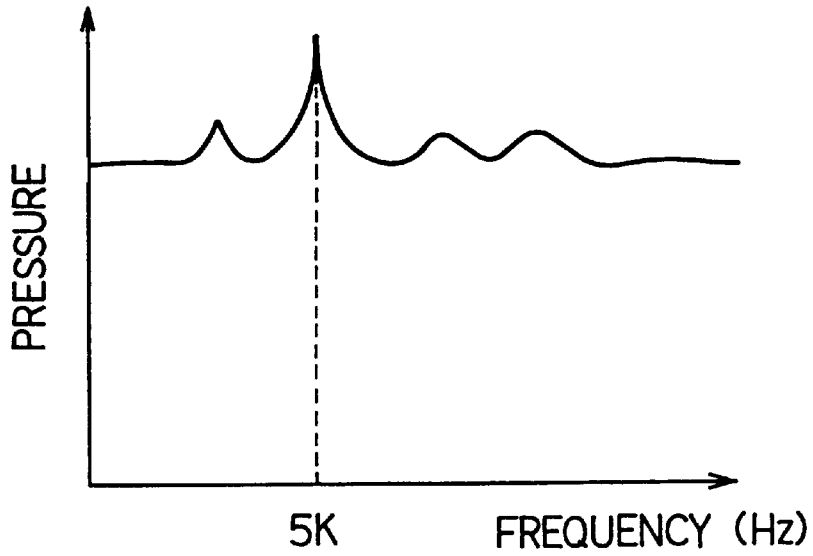

Incidentally, when the pressure waves have a frequency property shown in FIG. 10 within the inner tube that does not hay any punch holes, the pressure energy at a specific frequency, i.e., at approximately 5 kHz in FIG. 10, can be reduced by appropriately design the inner tube to have the punch holes 25. As a result, the high frequency noise at the specific frequency can be selectively reduced.

Third Embodiment

Next, a third preferred embodiment will be explained focusing on points different from the first embodiment.

Figure 11:
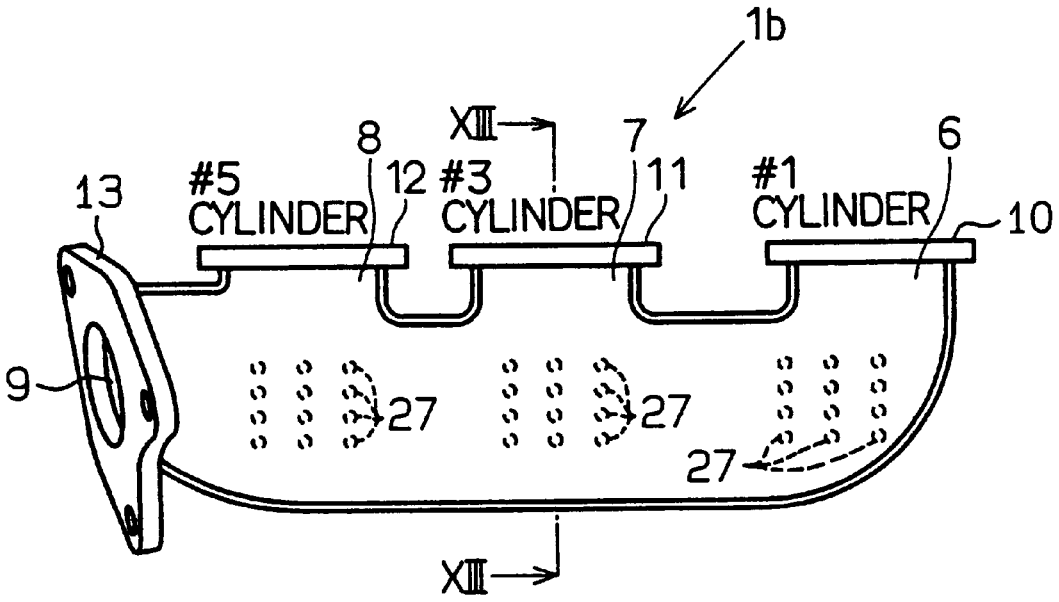
FIG. 11 is a schematic view showing an exhaust manifold in a third preferred embodiment.
Figure 12:
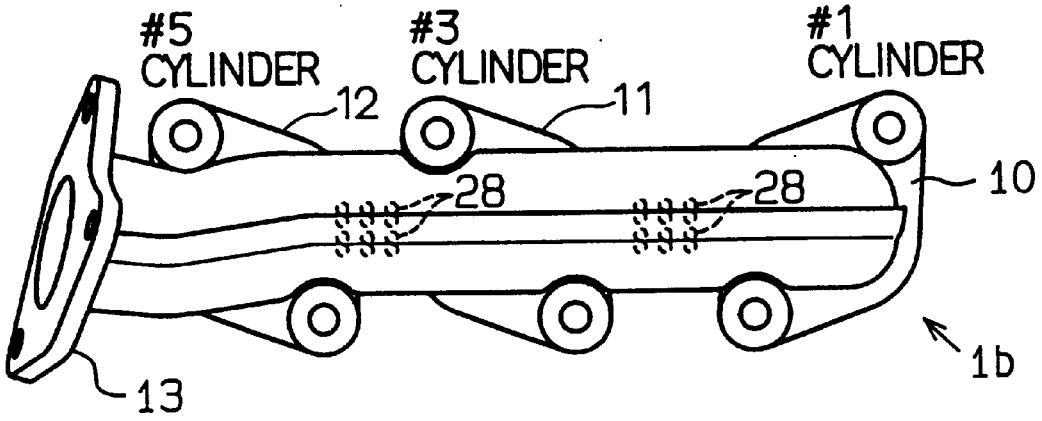
FIG. 12 is a front view showing the exhaust manifold in the third embodiment.
Figure 13:
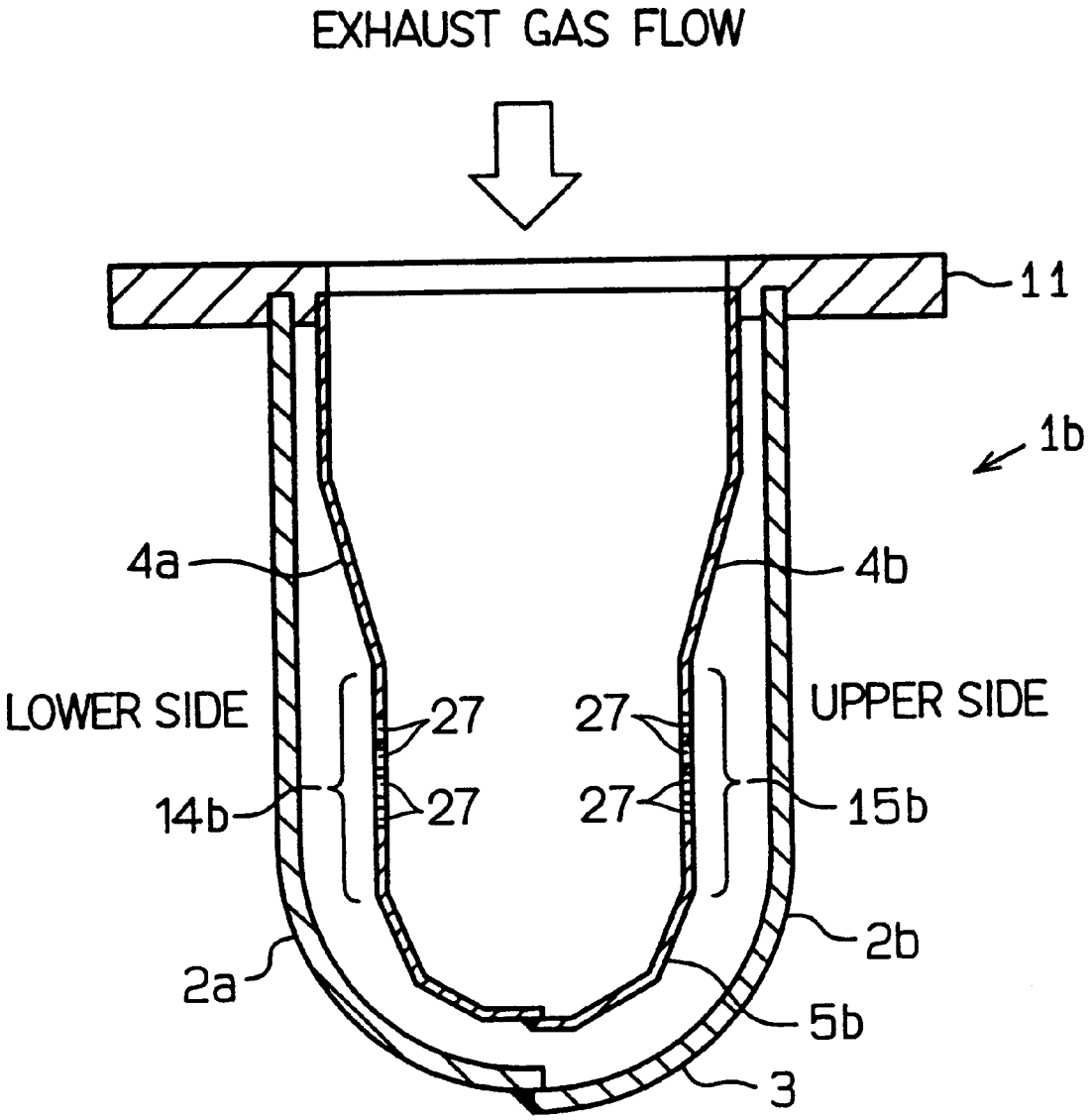
FIG. 13 is a cross-sectional view taken along a XIII—XIII line in FIG. 11.

Referring to FIGS. 11 to 13, an inner tube 5*b* in the third embodiment has a plurality of punch holes 27 at flat portions 14*b*, 15*b*, and a plurality of punch holes 28 at other specific portions (see FIG. 12) not to disturb the exhaust gas flow. A diameter of each of the punch holes 27, 28 is approximately 2 mm. Accordingly, the pressure waves having two specific frequencies F1, F2 can be lowered. Specifically, in this embodiment, the punch holes 27 damp the pressure waves of around 3 kHz, while the punch holes 28 damp the pressure waves of around 5 kHz. As in the second embodiment, further, the area of the inner tube 5*b* for receiving the pressure waves is reduced due to the punch holes 27, 28. Accordingly, the vibration of the inner tube 5*b* is reduced, so that the high frequency vibration transmitted to the outer tube 3 is reduced. Consequently, the high frequency noise generated from the outer tube 3 is reduced.

Incidentally, the high frequency noise can be selectively lowered in accordance with its frequency by appropriately design the diameter, pitch, and the like of the punch holes 27, 28. The vibration reduction effect by the punch holes 27, 28 becomes large approximately in proportion to the number of the punch holes 27, 28. These points were experimentally confirmed by the inventors.

In this embodiment, because each diameter of the punch holes 27, 28 is approximately 2 mm, the pressure waves do not directly vibrate the outer tube 3. Although the punch holes which are formed at the specific portion reduce only the noise with the specific frequency, the noise with another specific frequency can be reduced by forming the punch holes at another specific portion. That is, the frequency of noise that is to be lowered is controlled based on the position where the punch holes are formed. The noise with a plurality of frequencies can be simultaneously reduced by forming the punch holes at a plurality of portions.

Forth Embodiment

Next, a fourth preferred embodiment will be explained focusing on points different from the first embodiment.

Figure 14:
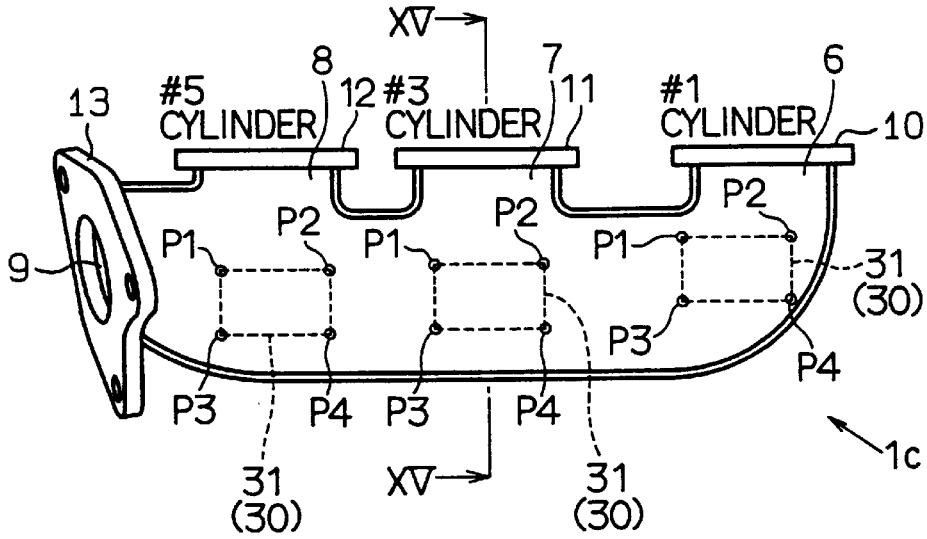
FIG. 14 is a schematic view showing an exhaust manifold in a fourth preferred embodiment.
Figure 15:
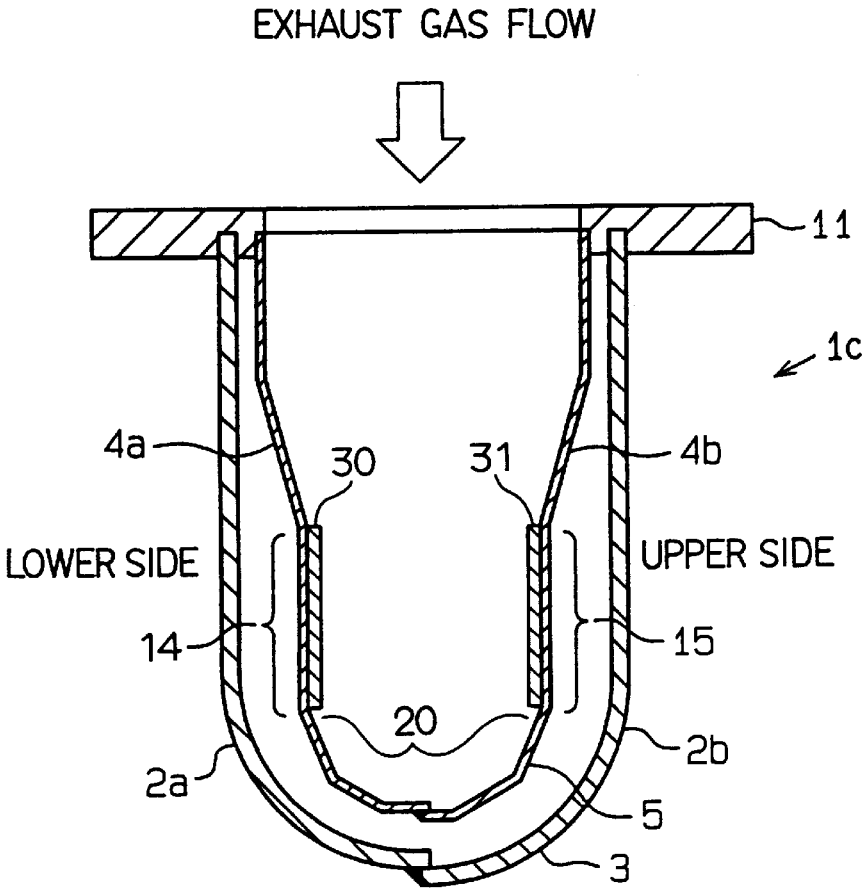
FIG. 15 is a cross-sectional view taken along a XV—XV line in FIG. 14.

FIGS. 14, 15 show an exhaust manifold 1*c* in the fourth embodiment. The appearance of the exhaust manifold 1*c* is substantially the same as that in the first embodiment. The outer and inner tubes 3, 5 are spot-welded to the head flanges 10, 11, 12, and the outer tube 5 is welded to the flange 13. In this embodiment, rectangular contact plates 30, 31 are disposed on the inner surface of the flat portions 14, 15 of the inner tube 5. The contact plates 30, 31 are welded at respective four corners thereof. The weld portions of the contact plates 30, 31 are indicated with P1–P4 in FIG. 14. Each thickness of the contact plates 30, 31 is approximately 1 mm–2 mm.

Thus, the rectangular contact plates 30, 31 respectively face-contact the flat portions 14, 15 of the inner tube 5, so that the vibration produced at the flat portions 14, 15 is prevented by contact friction between the contact plates 30, 31 and the flat portions 14, 15. That is, the pressure waves of the exhaust gas discharged from the cylinders directly vibrates not the flat portions 14, 15 but the contact plates 30, 31, and the vibration generated at the contact plates 30, 31 is damped by friction at the contact portions between the inner tube 5 and the contact plates 30, 31.

The vibration generated at the butting portion 20 of the inner tube 5 by the pressure waves is transmitted to the flat portions 14, 15, and is also damped at the flat portions 14, 15 by the friction between the inner tube 5 and the contact plates 30, 31. As a result, high frequency noise produced from the outer tube 3 can be reduced. The contacts plates 30, 31 can be replaced with other members capable of producing a frictional force with the inner tube 5. The shape of the contacts plate 30, 31 is not limited to the rectangle and is changeable. It is not always necessary for the contact plates 30, 31 to be fixed to the inner tube 5 by welding. For example, the contact plates 30, 31 may be fixed to the inner tube 5 by using bolts and the like.

Fifth Embodiment

Next, a fifth preferred embodiment will be explained focusing on points different from the first embodiment.

Figure 16:
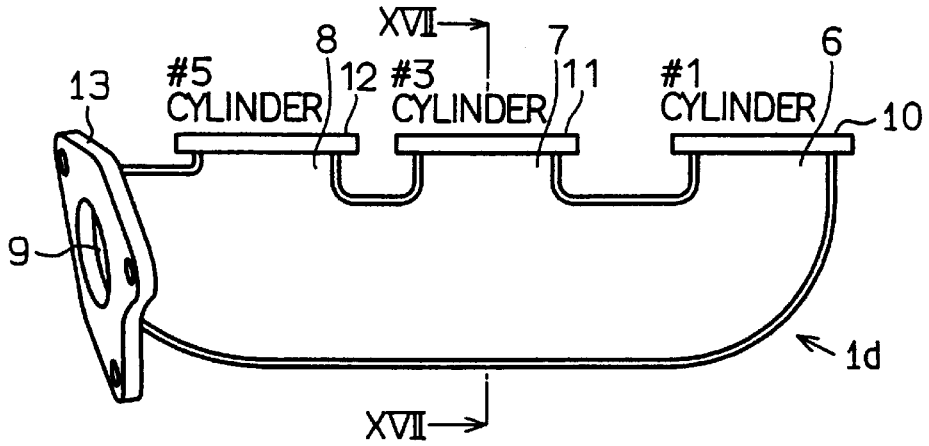
FIG. 16 is a schematic view showing an exhaust manifold in a fifth embodiment.
Figure 17:
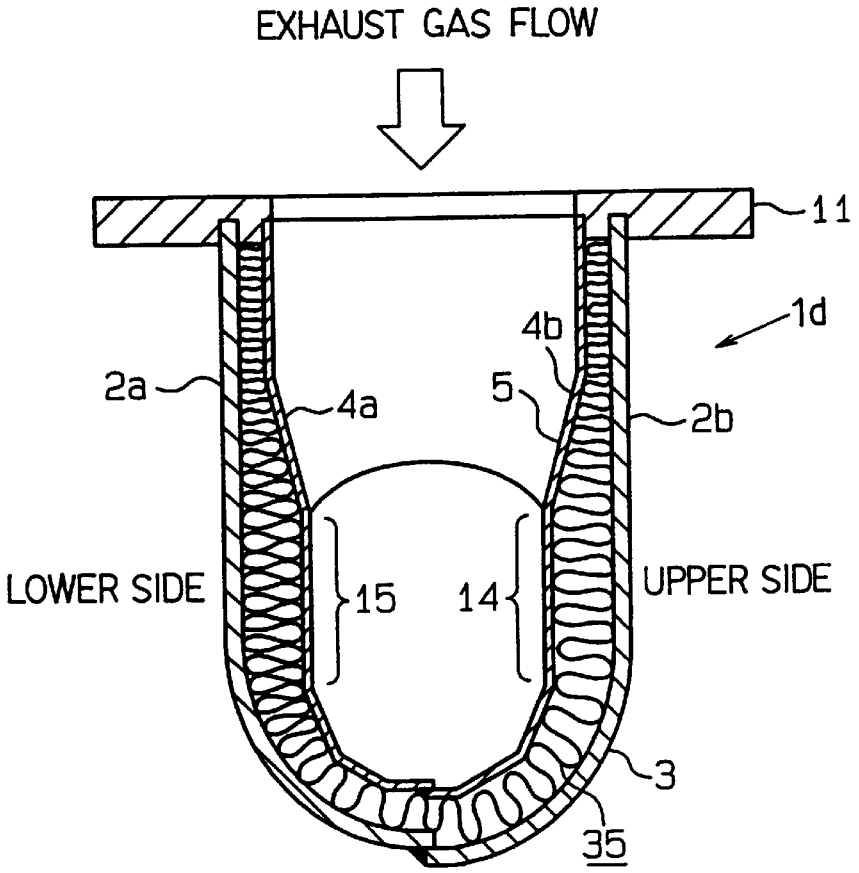
FIG. 17 is a cross-sectional view which is taken along a XVII—XVII line in FIG. 16.

FIGS. 16, 17 show an exhaust manifold 1*d* in the fifth embodiment, in which the same parts as in the first embodiment are indicated with the same reference numerals. The appearance of the exhaust manifold 1*d* is substantially the same as that in the first embodiment. In this embodiment, a lamination corrugated sheet 35 is disposed in the space between the inner and outer tubes 5, 3 to contact the walls of the inner and outer tubes 5, 3. The thickness of the lamination corrugated sheet is approximately 1 mm.

Figure 18:
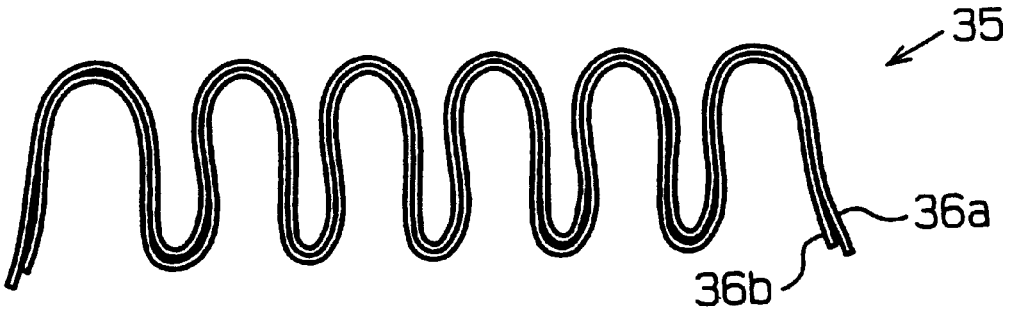
FIG. 18 is an illustration showing a lamination corrugated sheet of the exhaust manifold in the fifth embodiment.

Referring to FIG. 18, the lamination corrugated sheet 35 is formed form a plurality of (two in FIG. 18) sheet members 36*a*, 36*b* corrugated in a face-contacting state one another. In the exhaust manifold 1*d* in this embodiment, the vibration generated by the pressure waves of the exhaust gas is damped by contact friction between the lamination corrugated sheet 35 and the inner tube 5. Then, the vibration transmitted from the inner tube 5 to the lamination corrugated sheet 35 is further damped by contact friction between the sheet members 36*a*, 36*b* and by the contact friction between the lamination corrugated sheet 35 and the outer tube 3. In this way, the vibration is damped, so that the high frequency noise generated from the outer tube is lowered.

Next, a modified example of the fifth embodiment will be explained. In the exhaust manifold 1*d* shown in FIG. 17, although the lamination corrugated sheet 35 is disposed in the space between the outer and inner tubes 3, 5, a corrugated sheet composed of one sheet member may be disposed in the space to contact the both tubes 3, 5. Otherwise, a linear thick wire mesh may be disposed in the space to contact the both tubes 3, 5. In this case, the vibration generated by the pressure waves of the exhaust gas can be damped by contact friction between the wire mesh and the inner tube 5 and between the wire mesh and the outer tube 3.

Sixth Embodiment

Figure 19:
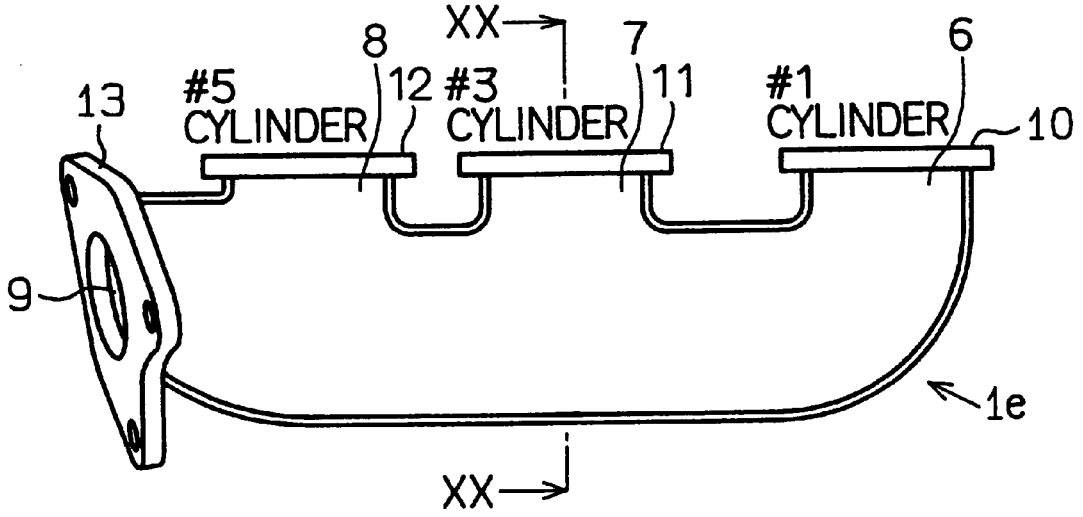
FIG. 19 is a schematic view showing an exhaust manifold in a sixth preferred embodiment.
Figure 20:
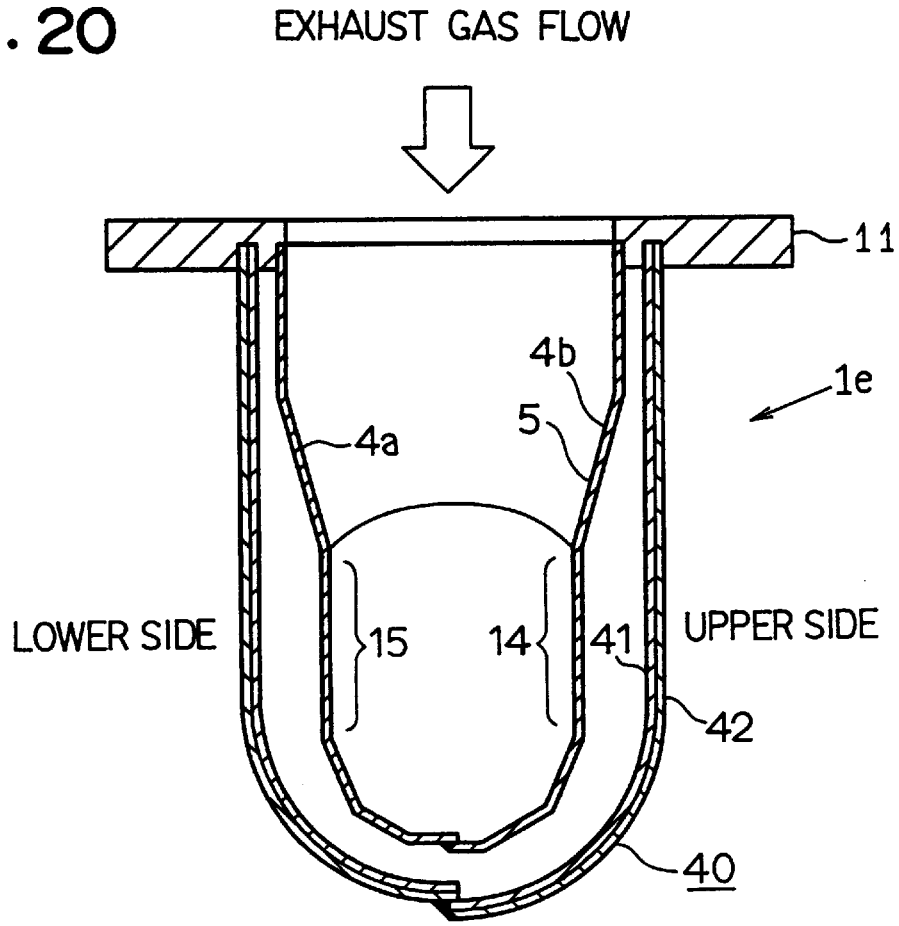
FIG. 20 is a cross-sectional view taken along a XX—XX line in FIG. 19.

Next, a sixth preferred embodiment will be explained focusing on points different from the first embodiment. FIGS. 19, 20 show an exhaust manifold 1*e* in the sixth embodiment. The appearance of the exhaust manifold 1*e* is substantially the same as that in the first embodiment. The inner tube 4 and an outer tube 40 are welded to the head flanges 10, 11, 12, and only the outer tube 40 is welded to the flange 13. In this embodiment, the inner tube 5 has the same structure as that in the first embodiment, and the outer tube 40 is different from that in the first embodiment. Specifically, the outer tube 40 is composed of inner and outer pipes 41, 42 which are made of stainless steel plates and contact one another at entire faces thereof. Each thickness of the inner and outer pipes 41, 42 is approximately 1.0 mm–1.5 mm.

Figure 35:
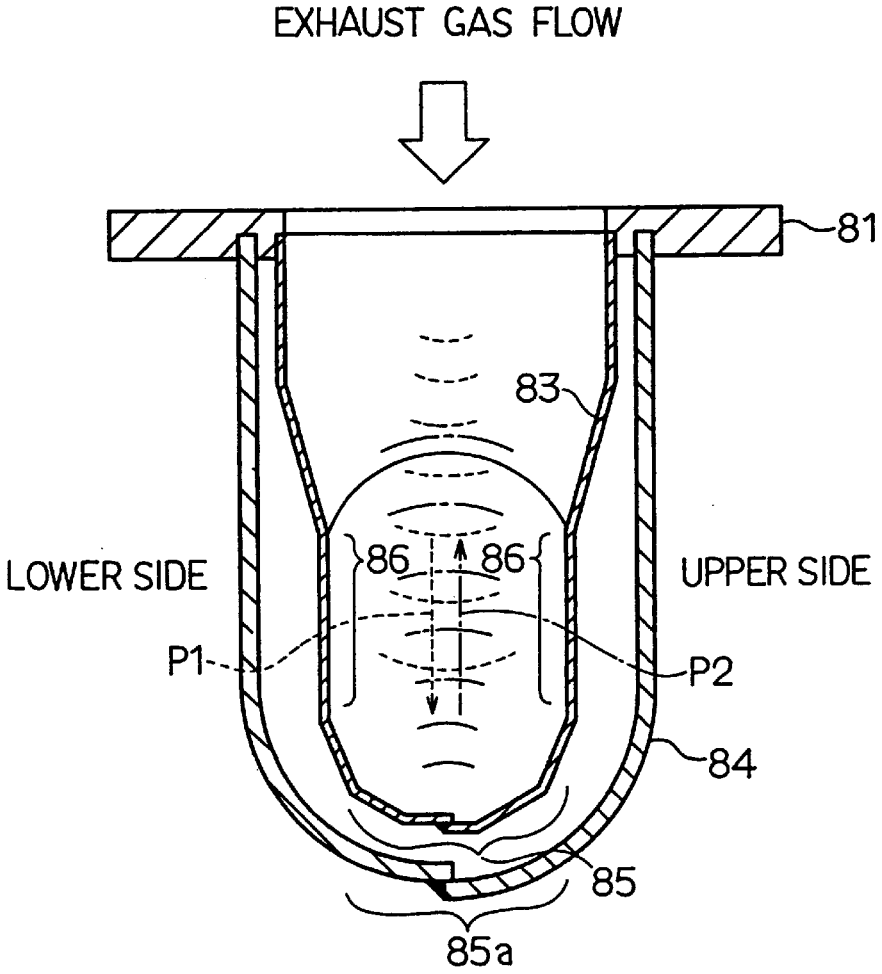
FIG. 35 PRIOR ART
FIG. 35 is a cross-sectional view which is taken along a XXXV—XXXV line in FIG. 33.

According to this structure, although the vibration generated at the inner tube 5 by the pressure pulsation of the exhaust gas is transmitted to the outer tube 40 through the head flanges 10, 11, 12, the vibration is damped at the outer tube 40 due to face contact between the inner and outer pipes 41, 42. As a result, high frequency noise generated by the outer tube 40 can be reduced. In the conventional structure shown in FIG. 35, the thickness of the outer tube 84 is in a rage of approximately 20 mm–3.0 mm, and in this embodiment, the thickness of the outer tube 40 is in a range of approximately 20 mm–3.0 mm. Therefore, according to the sixth embodiment, the high frequency noise can be reduced without increasing the weight of the exhaust manifold itself.

Figure 21:
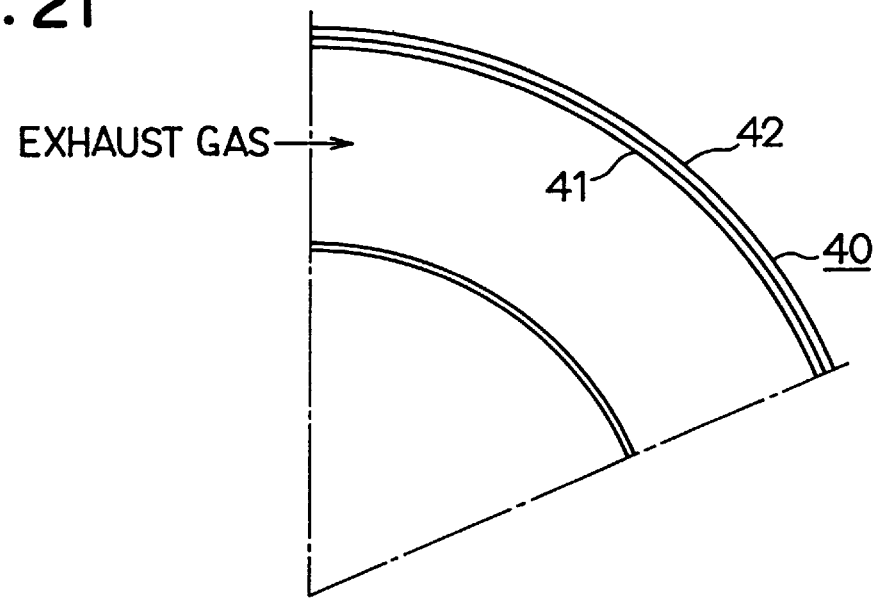
FIG. 21 is a cross-sectional view partially showing an outer tube of the exhaust manifold in the sixth embodiment.
Figure 22:
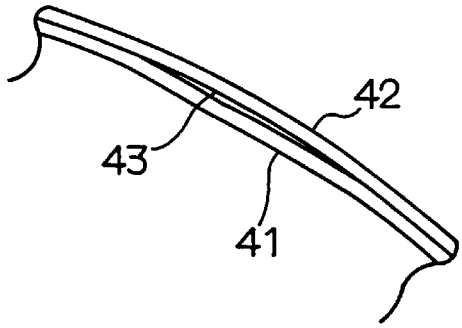
FIGS. 22, 23 are cross-sectional views partially showing the outer tube of the exhaust manifold before and after exhaust gas flows therein in the sixth embodiment.
Figure 23:
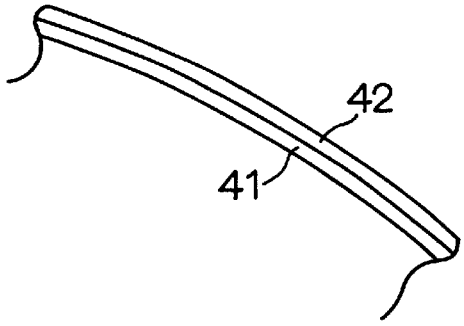

In this embodiment, to enhance the contact effect between the inner and outer pipes 41, 42 of the outer tube 40, the outer pipe 42 is made of material having a small thermal expansion coefficient and the inner pipe 41 is made of material having a large thermal expansion coefficient. Accordingly, the contact effect of the outer tube 40 can be increased as large as possible by utilizing the heat within the exhaust pipe developed when the engine is driven. That is, at a bending portion of the outer tube 40 shown in FIG. 21, even if there exist a gap 43 between the inner and outer pipes 41, 42 as shown in FIG. 22 before the high temperature exhaust gas flows, the gap 43 decreases or disappears due to a difference in thermal expansion coefficient between the inner and outer pipes 41, 42 as shown in FIG. 23. As a result, the contact area between the inner and outer pipes 41, 42 is increased to enhance the contact effect for damping the vibration.

Seventh Embodiment

Next, a seventh preferred embodiment will be explained focusing on points different from the first embodiment.

Figure 24:
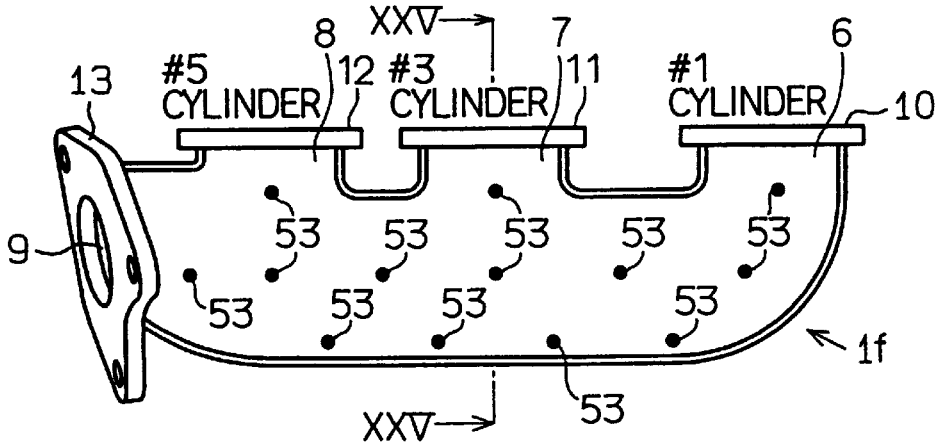
FIG. 24 is a schematic view showing an exhaust manifold in a seventh preferred embodiment.
Figure 25:
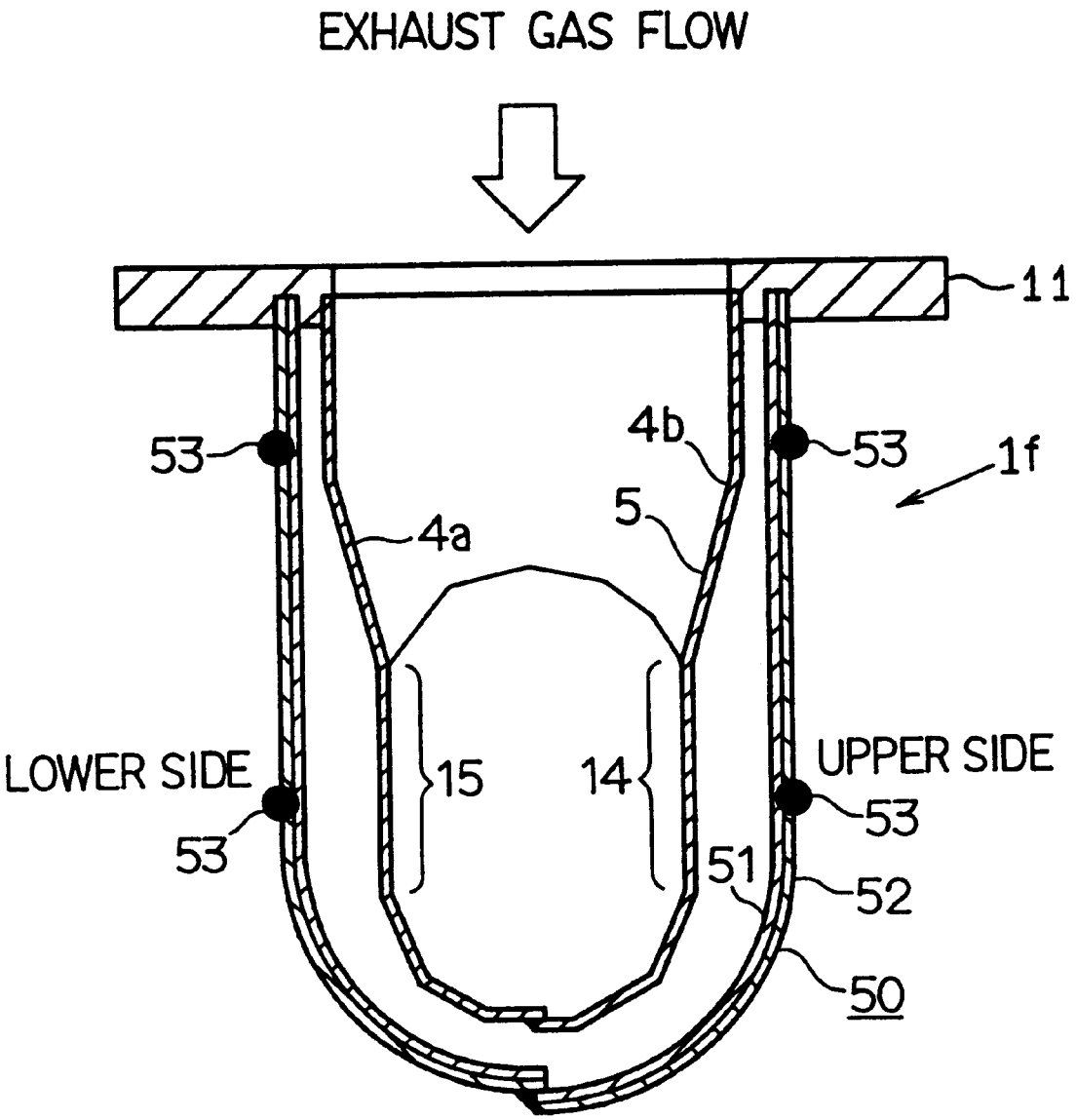
FIG. 25 is a cross-sectional view taken along a XXV—XXV line in FIG. 24.

FIGS. 24, 25 show an exhaust manifold if in the seventh embodiment. In this embodiment, although the inner tube 5 has the same structure as that in the first embodiment, an outer tube 50 is different from that in the first embodiment. The outer tube 50 is welded to the head flanges 10, 11, 12, and to the flange 13. The outer tube 50 has a double-pipe structure and damps the vibration transmitted from the inner tube 5 through the flanges 10–13 so as to reduce the high frequency noise.

More specifically, the outer tube 50 is composed of an inner pipe 51 and an outer pipe 52 which are made of stainless steel plates and contact one another at entire faces thereof. The inner and outer pipes 51, 52 are welded to one another at a plurality of spot weld portions 53. The spot weld portions 53 are welded from the outer pipe side to fix the outer and inner pipes 51, 52 together. Accordingly, the contact area between the inner and outer pipes 51, 52 is securely increased, so that the vibrations of the respective pipes 51, 52 can be lowered by the face contact between themselves.

In this embodiment, the number of the spot weld portions 53 is optimized to be 26. The thickness of the outer pipe 52 is thicker than that of the inner pipe 51. The portions corresponding to antinode of the vibration of the inner pipe 51 are welded to the outer pipe 52 as the spot weld portions 53. As a result, the vibration generated at the outer tube 50 is reduced as compared to the conventional structure in which the outer tube is composed of one plate, so that the high frequency noise is lowered.

Figure 26:
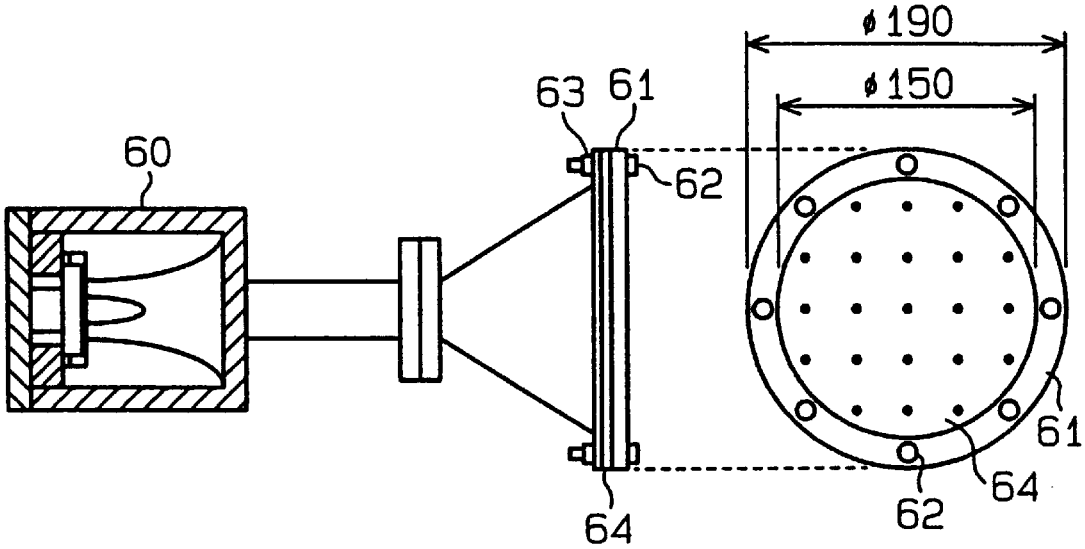
FIG. 26 is an illustration for explaining a measurement system.
Figure 27:
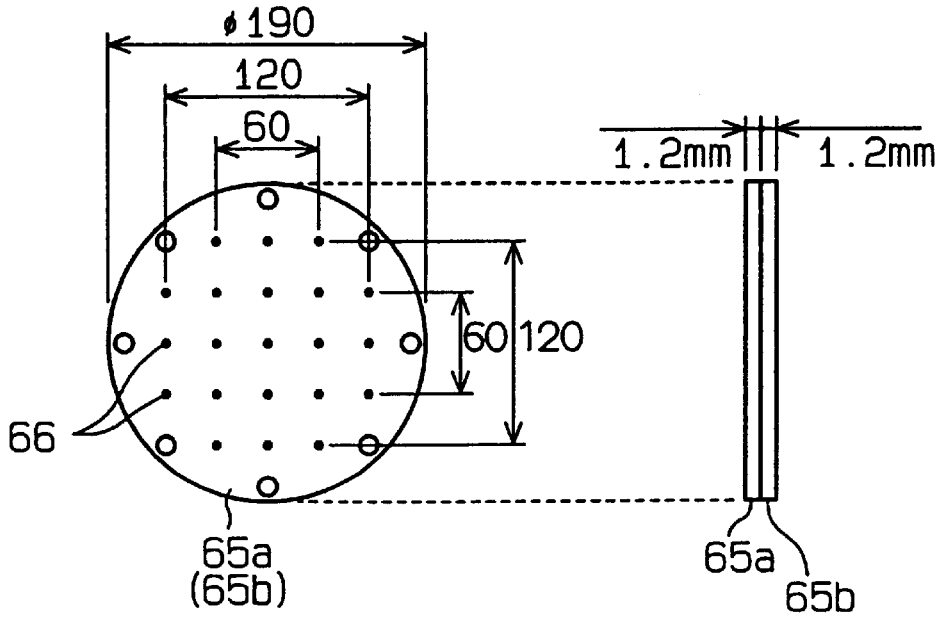
FIG. 27 is an illustration for explaining a test sample.
Figure 28:
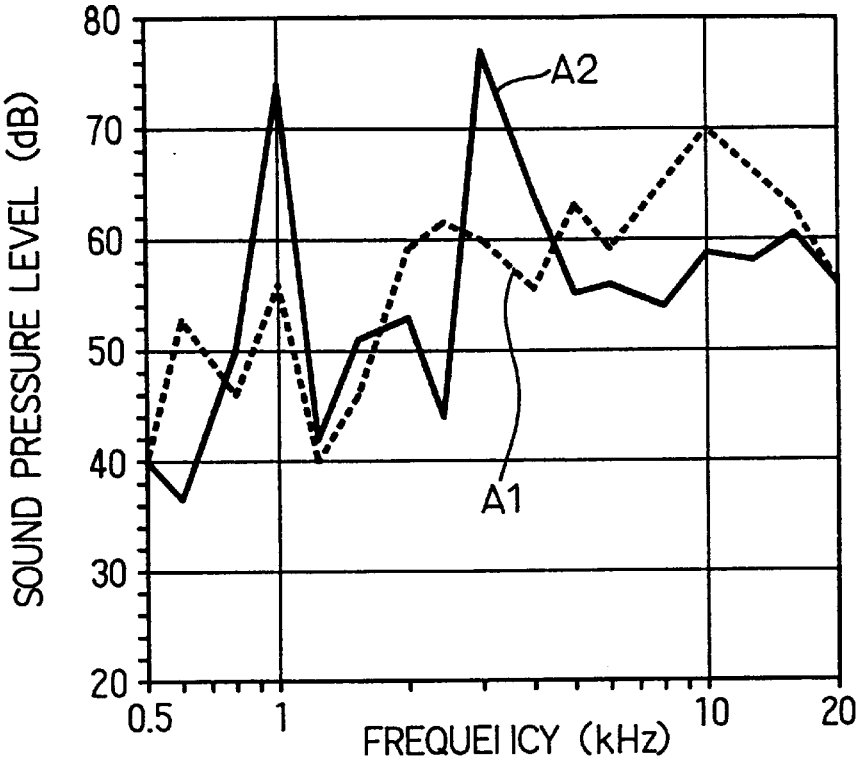
FIGS. 28 to 30 are graphs showing frequency properties, respectively.

Next, model experiments that were performed in a manner shown in FIG. 26 will be explained. In FIG. 26, a circular plate 64 as a test sample (piece) is disposed with respect to a tweeter-speaker 60 using a presser flange 61, bolts 62 and nuts 63. The circular plate 64 is 190 mm in outer diameter and an exposed portion of the circular plate 64 from the presser flange 61 is 150 mm in diameter. The circular plate 64 is vibrated by sound pressure generated by the tweeter speaker 60. Two samples A1, A2 of the circular plate 64 were prepared. Sample A1 was as shown in FIG. 27 composed of two plates 65*a*, 65*b* welded at 21 spot weld portions and each having a thickness of 1.2 mm, and sample A2 was composed of a plate having a thickness of 3.0 mm. Then, radiation noises from sample A1, A2 were measured. The results are shown in FIG. 28. A microphone for measurement was disposed at a position apart from the samples (64) by 10 cm. The following experiments were performed under the same conditions.

As shown in FIG. 28, an overall (OA) value in a range of 1 kHz–20 kHz of sample A2 was 77.7 dB. As opposed to this, an overall value in a range of 1 kHz–20 kHz of sample A1 was 74.0 dB. That is, sample A1 adopting the double-plate structure can provide a reduction effect corresponding to 3.7 dB in the overall value in the range of 1 kHz–20 kHz as compared to sample A2. The total thickness of the double-plate structure of sample A1 is 2.4 mm thinner than that (3 mm) of sample A2, nevertheless, the effect of reducing the high frequency noise of sample A1 is larger than that of sample A2.

Figure 29:
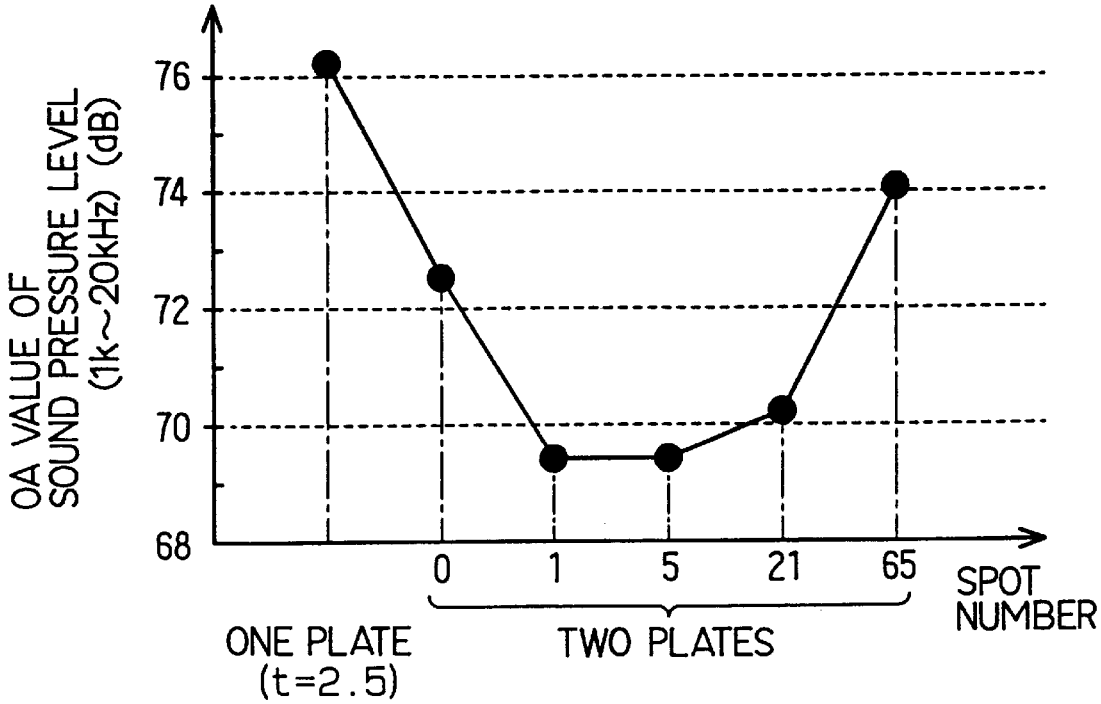

FIG. 29 shows a relationship between a number of the spot weld portions and high frequency noise. That is, the following six samples were measured. One was composed of a plate having a thickness of 2.5 mm. The other had a double-plate structure composed of two plates not welded or welded at specific spot weld portions, respectively. The number of the spot weld portions (spot number) were 0, 1, 5, 21, 65, respectively. As shown in FIG. 29, there is not a tendency that the larger the spot number becomes, the more the high frequency noise is reduced. There exists an optimum spot number. That is, it is confirmed that the noise reduction effect can be optimized when the circular plate having a diameter of 190 mm is welded approximately at five points.

Figure 30:
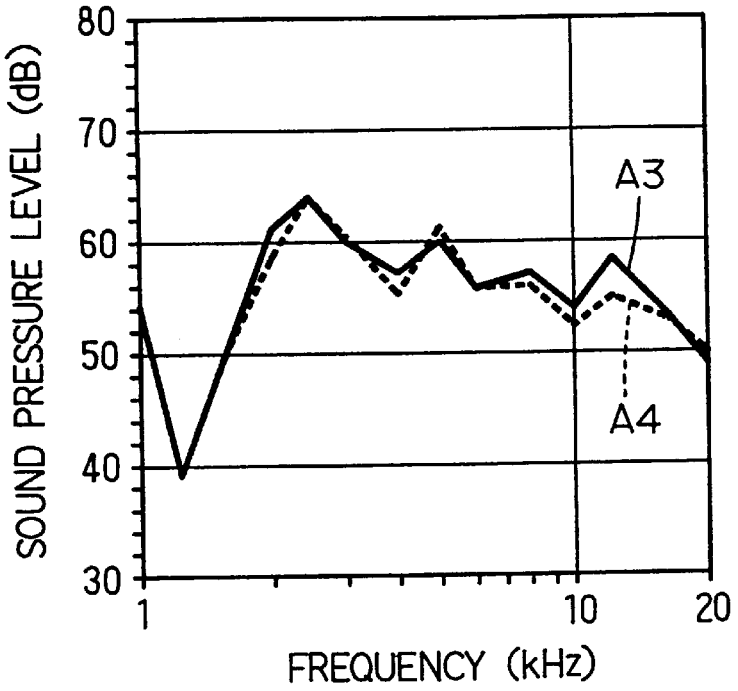

FIG. 30 shows measurement results of high frequency noise from sample A3, A4. Sample A3 is composed of an inside plate 65*a* having a thickness of 1.5 mm and an outside plate 65*b* having a thickness of 0.8 mm, which are welded at 21 points (spot weld portions). Sample A4 is composed of an inside plate 65*a* having a thickness of 0.8 mm and an outside plate having a thickness of 1.5 mm which are also welded at 21 points. The overall values in the range of 1 kHz to 20 kHz of sample A3 was 69.1 dB, while the overall value in the range of 1 kHz to 20 kHz of sample A4 was 68.7 dB. Thus, when the outside plate 65*b* has a thickness thicker than that of the inside plate 65*a*, high frequency noise having more than 10 kHz can be effectively reduced. Accordingly, it is confirmed that it is desirable to make the thickness of the outside plate 65*b* (the outer pipe 52 in FIG. 25) thicker than that of the inside plate 65*a* (the inner pipe 51 in FIG. 25) and to fix the inside and outside plates by spot-welding.

Figure 31A:
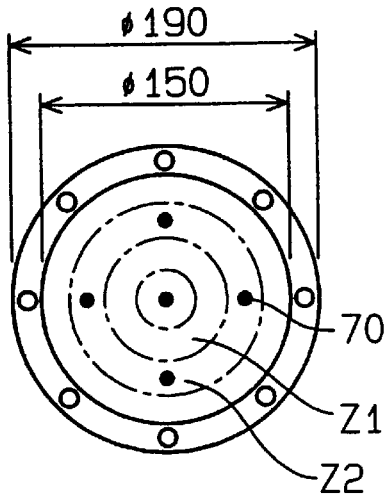
FIGS. 31A, 31B are illustrations for explaining test samples.
Figure 31B:
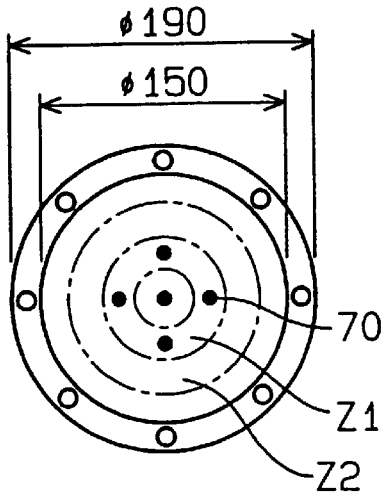

Next, a mode of vibration of the inside plate 65*a* disposed on a speaker side in FIG. 26 was measured by a laser Doppler vibration meter, and then two samples A5, A6, in which a portion (antinode of vibration) where the mode of vibration prominently largely vibrated was welded and was not welded, were examined. In sample A5 shown in FIG. 31A, an antinode region Z2 of the vibration was spot-welded, and in sample A6 in FIG. 31B, a node region Z1 of the vibration was spot-welded. The spot weld portions are indicated with numeral 70 in FIGS. 31A, 31B. That is, in this experiment, a relationship between the position of the spot-welding and the high frequency noise was examined. Incidentally, each thickness of the inside and outside plates 65*a*, 65*b* was 1.2 mm.

Figure 32:
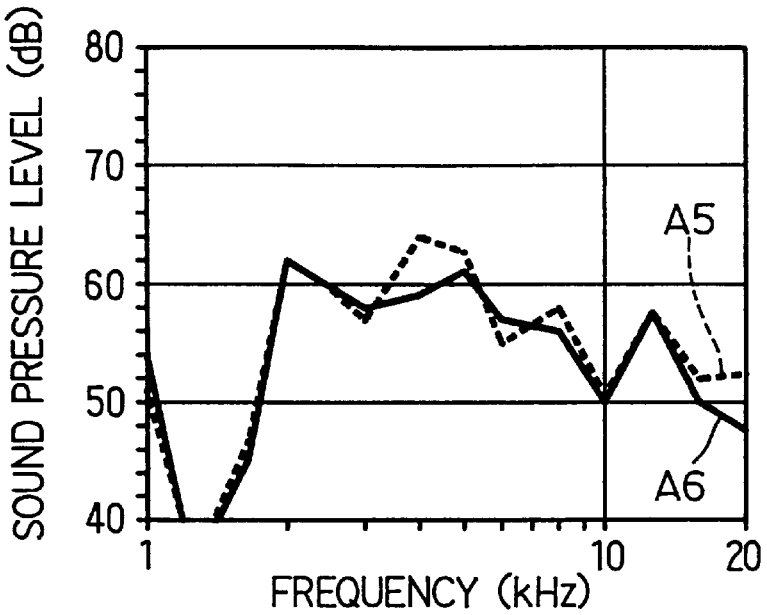
FIG. 32 is a graph showing a frequency property.
Figure 33:
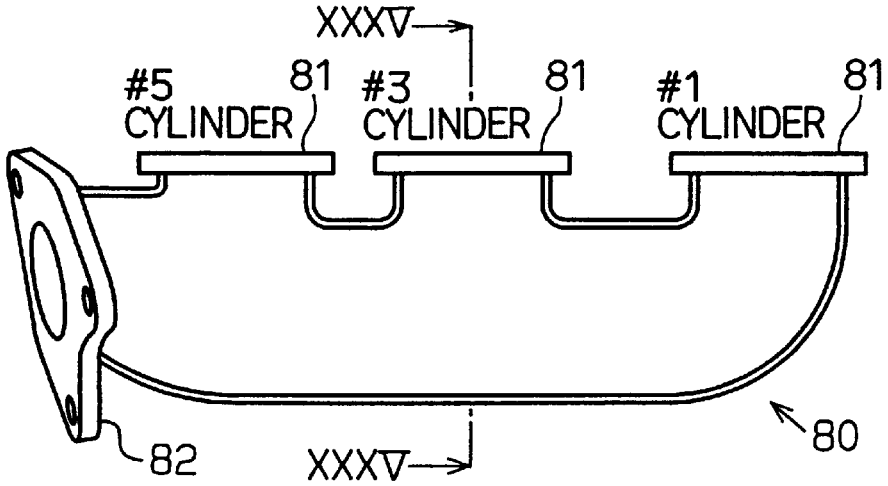
FIG. 33 PRIOR ART
FIG. 33 is a schematic view showing an exhaust manifold in a prior art.
Figure 34:
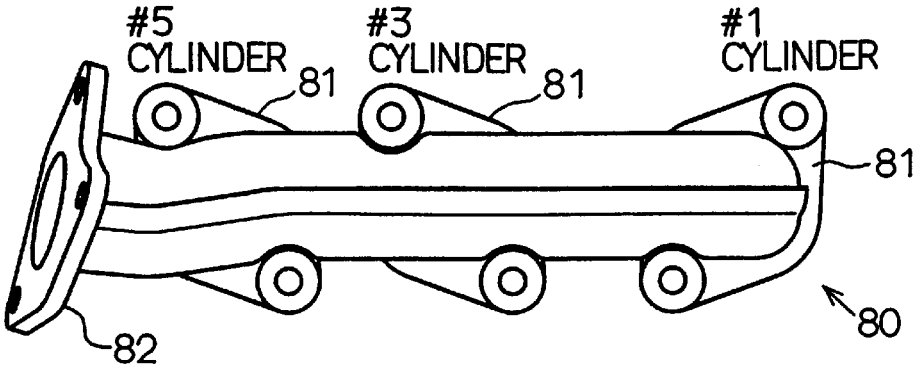
FIG. 34 PRIOR ART
FIG. 34 is a front view showing the exhaust manifold of FIG.33.

The results are shown in FIG. 32. The overall value in the range of 1 kHz to 20 kHz of sample A5 in which the antinode region Z2 was welded was 69.9 dB, while the overall value in the range of 1 kHz to 20 kHz of sample A6 in which the node region Z1 was welded was 68.5 dB. Accordingly, when two plates are spot-welded to reduce the high frequency noise by contact friction damping effect thereof, the contact friction damping effect of the two plates is enhanced when they are spot-welded to one another at the portions corresponding to the antinode region of the vibration of the plate 65*a* (the inner pipe 51 in FIG. 25) which is disposed at the inside.

In view of all the experimental results described above, in the exhaust manifold If in this embodiment, the outer tube 50 is composed of the inner and outer pipes 51, 52 which are spot-welded to one another at the spot weld portions 53. Accordingly, the vibration produced by the pressure waves of the exhaust gas ca be damped due to the contact friction between the inner and outer pipes 51, 52. The spot weld portions 53 correspond to the antinode region of the vibration. Further, the thickness of the outer pipe 52 is thicker than that of the inner pipe 51. As a result, the contact friction damping effect is easily and effectively provided.

In the exhaust manifold if shown in FIG. 25, (i) the number of the spot weld portions 53 is optimized, (ii) in the outer tube 50, the thickness of the outer tube 52 disposed at the outside is set to be thicker than that of the inner tube 51, and (iii) the portions corresponding to the antinode region of the vibration are spot-welded as the spot weld portions 53. However, it is not always necessary to perform all of the above three countermeasures. It may be sufficient to perform only one or two countermeasures of the above countermeasures (i), (ii), (iii). The spot welding may be performed to the outer tube 50 from the outer pipe side or from inner pipe side. It is apparent that some of the embodiments described above can be selectively and appropriately combined with one another to enhance the noise reduction effect.

While the present invention has been shown and described with reference to the foregoing preferred embodiments, it will be apparent to those skilled in the art that changes in form and detail may be made therein without departing from the scope of the invention as defined in the appended claims.

What is claimed is:

1. An exhaust manifold comprising:

a stainless inner tube having a plurality of intake ports for receiving exhaust gas from an engine and an exhaust port for discharging the exhaust gas; and a stainless outer tube disposed on an outside of the inner tube and defining a space with the inner tube, wherein the outer tube is composed of outer and inner plate members face-contacting one another for lowering vibration caused by pressure waves of the exhaust gas by means of contact friction between the outer and inner plate members.

2. The exhaust manifold of claim 1, wherein a thickness of the outer plate member is thicker than that of the inner plate member.

3. The exhaust manifold of claim 1, wherein the outer and inner plate members of the outer tube are spot-welded to one another.

4. The exhaust manifold of claim 3, wherein the outer and inner plate members are spot-welded at a portion corresponding to antinode of vibration.

* * * * *